United States Patent [19]

Benarrouch

[11] 4,445,609

[45] May 1, 1984

[54] REFILLABLE SOFT TUBE FOR PACKAGING LIQUID OR PASTE PRODUCTS SUCH AS TOOTHPASTE, POLISH, SHAVING CREAM OR THE LIKE

[75] Inventor: Jacques Benarrouch, Villeurbanne, France

[73] Assignee: Sasson Jeans, Inc., New York, N.Y.

[21] Appl. No.: 392,778

[22] Filed: Jun. 28, 1982

[51] Int. Cl.[3] ..... B65D 85/14; B65D 35/02

[52] U.S. Cl. ..... 206/277; 383/91; 222/99

[58] Field of Search ..... 206/277; 229/65; 222/99

[56] References Cited

U.S. PATENT DOCUMENTS

| | | | |
|---|---|---|---|
| 955,530 | 4/1910 | Morrison | 222/99 |
| 3,086,264 | 4/1963 | Tindall | 229/65 |
| 3,199,737 | 8/1965 | Koffler | 222/99 |
| 3,257,038 | 6/1966 | Balke | 222/99 |

*Primary Examiner*—William T. Dixson, Jr.

*Attorney, Agent, or Firm*—Kane, Dalsimer, Kane, Sullivan & Kurucz

[57] ABSTRACT

A soft tube intended for packaging paste products is provided. The bottom end of the tube to be filled is flattened and folded upon itself. The result is a four-ply area which is sealed by slipping a U-shaped clip into place covering it.

6 Claims, 9 Drawing Figures

REFILLABLE SOFT TUBE FOR PACKAGING LIQUID OR PASTE PRODUCTS SUCH AS TOOTHPASTE, POLISH, SHAVING CREAM OR THE LIKE

BACKGROUND OF THE INVENTION

The present invention relates to a refillable soft tube of novel type intended to be used for packaging paste products such as, for example, shaving cream, toothpaste, polishes, sauces, condiments in paste form, or various food products.

It is well known that paste products may be packed in a tube having the top end closed with a screw cap while the bottom end is closed upon itself by rolling, milling, clamping, or welding in the case of a tube made of plastic.

Such known tubes have the disadvantage of being usable once only, after which they are discarded. The object of the present invention is to avoid this disadvantage by producing a packaging tube that may be refilled at will by the user, but will not leak.

SUMMARY OF THE INVENTION

A soft tube according to the invention for packaging a paste product comprises a hollow tubular body of deformable material, the top end of which will accept a screw cap while the bottom end, open before the tube is filled, is intended to be closed, flattened, then folded upon itself after filling, and is characterized by comprising a third part, namely a transverse clip of U-shaped cross section to be slipped across the bottom end, flattened and folded upon itself, of the body of the tube.

According to another feature of the invention, the U-shaped clip is open at both ends.

According to another feature of the invention, the U-shaped clip has on the inner face of one of its two arms, near the upper free edge of the latter, a ledge of a depth extending over about half the distance between the opposed inner faces of the two arms of the U.

According to another feature of the invention, the length of the ledge is slightly less than the length of the clip, with which it is made in one piece, so that near one end of the clip, its inside space is completely clear between the two opposed faces of the arms of the U. This serves to provide an entry facilitating placement of the clip when it is first engaged with the folded bottom end of the filled tube.

According to another feature of the invention, the wall of the tube, near its bottom end, has a peripheral groove, thinning the said wall locally, to facilitate and determine its folding upon itself in preparation for placement of the transverse clip.

According to another feature of the invention, the distance between the peripheral groove and the bottom edge of the wall of the tube before filling is substantially equal to the height of the clear space bounded inside the clip between the bottom thereof and the projecting ledge.

BRIEF DESCRIPTION OF THE DRAWINGS

The accompanying drawing, presented by way of example but not of limitation, will serve for a better understanding of the features of this invention.

DETAILED DESCRIPTION OF THE PREFERRED EMBODIMENT

Figure 1:
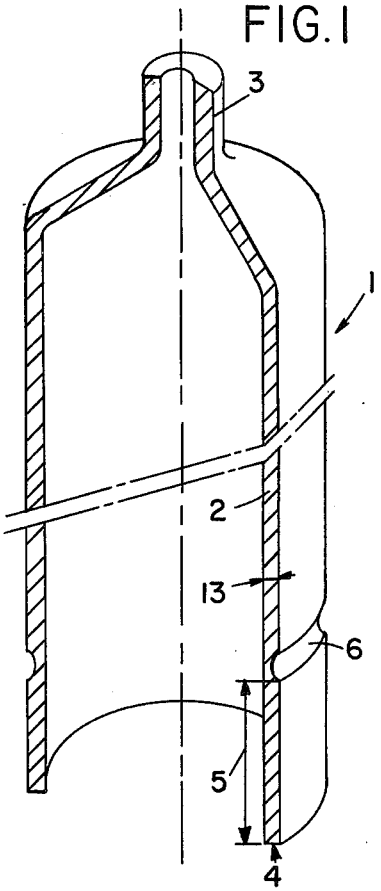
FIG. 1 is a view in axial section of the body of a tube according to the invention, before filling.

The drawings show the body 1 of a dispensing tube. Said body 1 is made in one piece of soft plastic material, so that its wall 2 is deformable. At its upper end, the body 1 terminates in a threaded mouth 3 intended to accept a cap, not shown, to be screwed on in a known manner.

At its bottom end, the body 1 is open and has a free bottom edge 4. At a slight distance 5 above said free bottom edge 4, the wall 2 has a peripheral groove 6 locally reducing its thickness and providing a fold line.

Figure 4:
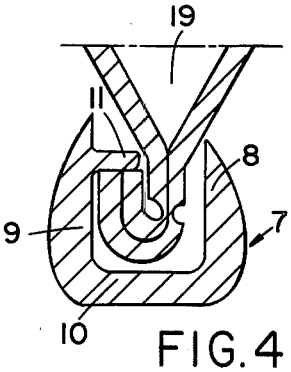
FIG. 4 shows the closed tube after placement of a transverse sealing clip to the invention.
Figure 5:
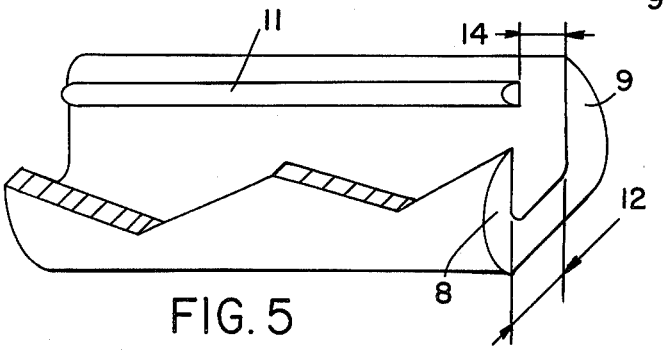
FIG. 5 is a pictorial view of the transverse clip with a portion cut away.

Further, the present invention provides for the use of a clip 7 made in one piece of metal or plastic material. Said clip has a U-shaped cross section with two side arms 8 and 9 joined at the bottom by a web 10 (FIG. 4). On the inner face of arm 9, near its top, a ledge projects substantially over half the distance 11 between the two opposed inner faces of the arms 8 and 9 of the U. This distance 12 is substantially equal to four times the thickness 13 of the wall 2 of the body 1 of the tube.

Further, the ledge 11 extends throughout the length of the clip 7 except near one end, where the ledge 11 is absent over a distance 14. This area provides a sort of "entry" to facilitate insertion of the filled tube folded at its bottom end, as will be seen below.

The mode of operation is as follows.

Figure 6:
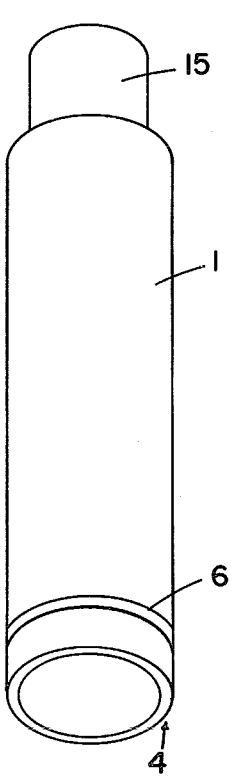
FIG. 6 shows the tube with its peripheral groove.

In FIG. 6, the body 1 of the tube is assumed to have been closed with a screw cap 15. On the other hand, the free edge 4 of the bottom end of the body of the tube bounds a more or less circular opening through which the user may fill or refill the tube. This filling is done by any known means for filling the tube with a paste product 19 (FIGS. 2 to 4).

Figure 2:
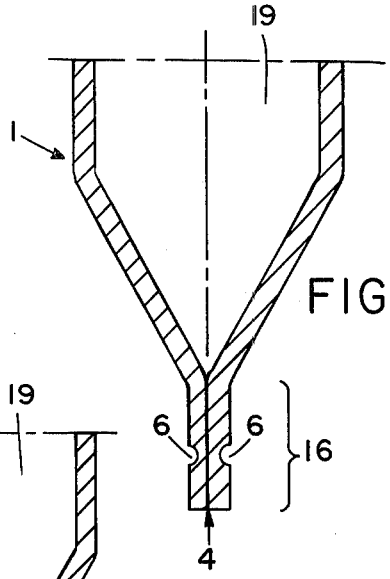
FIG. 2 shows the bottom end flattened after filling.
Figure 3:
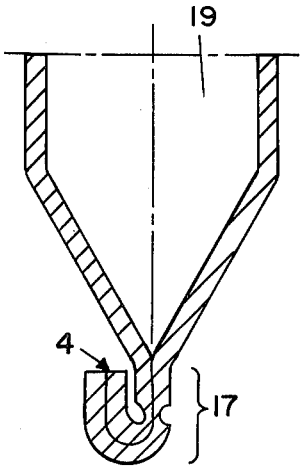
FIG. 3 is a similar view in which the flattened bottom end has been folded over upon itself.

When the tube is filled, its bottom end is flattened as shown in FIG. 2, so that the bottom edge 4 determines a flat portion of double thickness. This two-thickness area 16 (FIG. 2) is thinner at the two straight transverse grooves, now facing each other, because of the presence of the groove.

When the portion 16 is folded again, a four-fold thickness portion 17 is obtained (FIG. 3), the folding having been facilitated by the groove 6.

Figure 7:
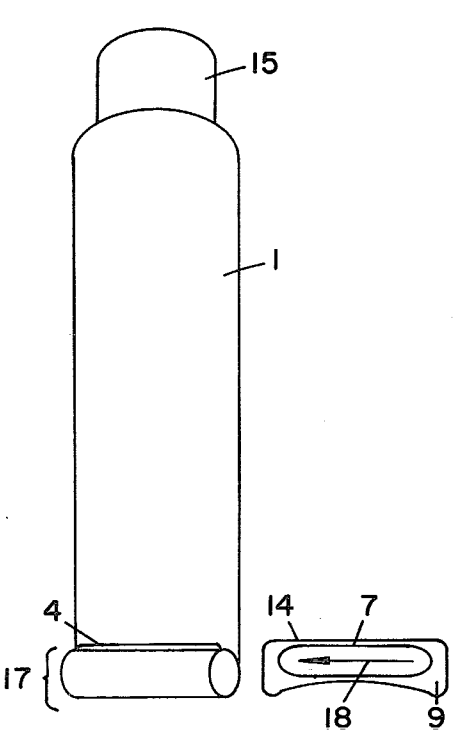
FIG. 7 shows the tube and its associated clip.

The clip 7 is then held as indicated in FIG. 7, the arm 9 with ledge 11 being one the same side as the free end 4.

Figure 9:
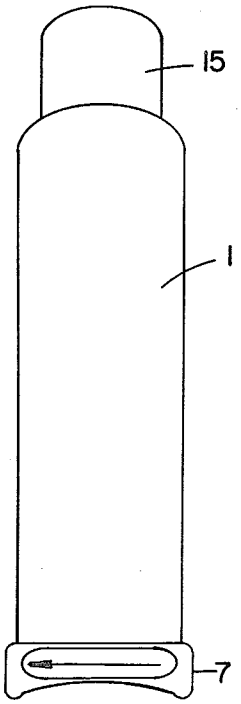
FIGS. 8 and 9 show the clip being slipped into place.
Figure 8:
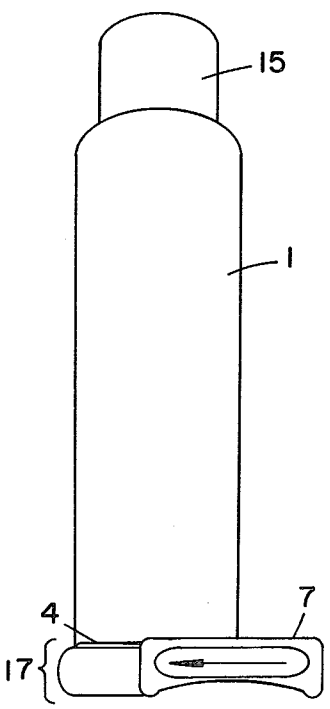

The first insertion in the clip 7 is facilitated by the entry region 14, to be first engaged over the flattened bottom end of the tube as indicated in FIG. 8. To facilitate and guide this insertion, preferably an arrow 18 is provided, which may be molded in relief on the outside of arm 9 of the 8 (FIG. 7). The insertion is continued as shown in FIG. 8 by sliding along the four-ply folded portion 17 into the position shown in FIG. 9, where the full tube has been finally closed and is ready for use. In this position, the clip 7 covers the entire width of the flattened bottom end of the tube.

The present invention provides great advantages; in the first place, it enables the user to reload the tube, which can thus be used indefinitely.

In the second place, and more important, such repeated use will greatly prolong the advertising impact of any message displayed on the tube. For example, tubes may be distributed to airline passengers, and bear a device displaying the emblem of the airline. Ordinarily, tubes thus distributed are used during the flight and then discarded by the users. With the present invention, the passenger will tend to keep the tube after emptying it of its contents (toothpaste, shaving cream), for later reuse. He will thus keep the advertising emblem of the airline, of which he will be reminded on each occasion of use.

Finally, the proposed embodiment ensures a perfectly tight seal at the clip 7 clamped on the bottom of the tube.

Obviously the invention may be used for packaging any liquid or paste products.

Having thus described the invention, what is claimed is:

1. A soft tube for packaging a liquid or paste product, comprising a hollow tubular body of deformable material, the top end of which will accept a screw cap, while the bottom end, open before the tube is filled, is intended to be closed, flattened, then rolled upon itself after filling, characterized by comprising a third part, namely a transverse clip of U-shaped cross section having a bottom web, a pair of arms and a ledge extending from one arm, said clip being adapted to be slipped across the bottom end of the body of the tube which has been flattened and folded upon itself and the wall of the tube comprises, near its bottom end a peripheral groove locally thinning the said wall to facilitate and determine its folding upon itself in preparation for placement of the transverse clip, the distance between the peripheral groove and the bottom free edge of the wall of the tube before folding is substantially equal to the height of the clear space bounded inside the clip between the web thereof and the projecting ledge.

2. A soft tube according to claim 1, characterized in that the U-shaped clip is open at both ends.

3. A soft tube according to claims 1 or 2 characterized in that the U-shaped clip comprises, on the inner face of one of its two flanges, near the upper free edge thereof, a projecting ledge of depth extending over about half the distance between the opposed inner faces of the two flanges of the U.

4. A soft tube according to claim 3 characterized in that the length of the ledge is slightly less than the length of the clip with which it is made in one piece, so that near one end of the clip, the inner space thereof is completely clear between the two opposed faces of the flanges of the U.

5. A soft tube according to claims 1, 2, 3 or 4, characterized in that the body of the tube is made of flexible plastic material.

6. A soft tube according to claims 1, 2, 3, 4, or 5, characterized in that the clip comprises, on the outer face of its flange with inner projecting ledge, a pointing arrow towards the area where the flange lacks the projecting ledge.

* * * * *